US010011944B2

(12) United States Patent
Poldervaart

(10) Patent No.: US 10,011,944 B2
(45) Date of Patent: Jul. 3, 2018

(54) HOLDER FOR LAUNDRY AND METHOD FOR MANUFACTURING SUCH HOLDER

(75) Inventor: Johann Albert Adriaan Poldervaart, Wassenaar (NL)

(73) Assignee: Lautratex B.V., Zoetermeer (NL)

( * ) Notice: Subject to any disclaimer, the term of this patent is extended or adjusted under 35 U.S.C. 154(b) by 70 days.

(21) Appl. No.: 13/577,636

(22) PCT Filed: Feb. 2, 2011

(86) PCT No.: PCT/EP2011/051487

§ 371 (c)(1),
(2), (4) Date: Aug. 7, 2012

(87) PCT Pub. No.: WO2011/098382

PCT Pub. Date: Aug. 18, 2011

(65) Prior Publication Data

US 2012/0308165 A1 Dec. 6, 2012

(30) Foreign Application Priority Data

Feb. 11, 2010 (EP) ..... 10153363

(51) Int. Cl.
*D06F 95/00* (2006.01)

(52) U.S. Cl.
CPC ..... *D06F 95/002* (2013.01)

(58) Field of Classification Search
CPC ..... D06F 95/006; D06F 95/002; A01N 59/16; A45C 3/00; Y10T 442/2525
USPC ..... 383/102, 105, 117
See application file for complete search history.

(56) References Cited

U.S. PATENT DOCUMENTS

| | | | | | |
|---|---|---|---|---|---|
| 2,511,644 | A | * | 6/1950 | Liss | 383/102 |
| 3,637,000 | A | * | 1/1972 | Walger et al. | 383/61.3 |
| 4,120,335 | A | * | 10/1978 | Mitchell | 383/7 |
| 4,979,833 | A | * | 12/1990 | Cook | 383/12 |
| 4,989,995 | A | * | 2/1991 | Rubenstein et al. | 383/117 |
| 5,071,699 | A | * | 12/1991 | Pappas et al. | 442/110 |
| 5,082,466 | A | * | 1/1992 | Rubenstein et al. | 8/142 |
| 5,092,682 | A | * | 3/1992 | Fenick | 383/22 |
| 5,432,000 | A | * | 7/1995 | Young et al. | 428/372 |
| 5,451,437 | A | * | 9/1995 | Insley | B01L 9/06 206/484.2 |
| 5,472,280 | A | * | 12/1995 | Rittmaster | 383/6 |
| 5,647,480 | A | * | 7/1997 | Insley | B65D 33/20 206/204 |
| 5,735,608 | A | * | 4/1998 | Branco | 383/25 |

(Continued)

FOREIGN PATENT DOCUMENTS

| | | |
|---|---|---|
| DE | 60109393 | 1/1996 |
| JP | 5170267 | 7/1993 |

(Continued)

OTHER PUBLICATIONS

Translation of Komatsu et al. (JP-5170267).*

*Primary Examiner* — Peter Helvey
(74) *Attorney, Agent, or Firm* — Marcus C. Dawes; Daniel L. Dawes

(57) ABSTRACT

Holder for laundry, in particular a laundry bag, manufactured from a woven textile, wherein the textile has a coarseness allowing said textile to breathe and wherein said textiles comprises first threads provided with an antibacterial agent, wherein the textile preferably comprises threads containing silver coated fibers.

11 Claims, 2 Drawing Sheets

(56) References Cited

Figure 1:
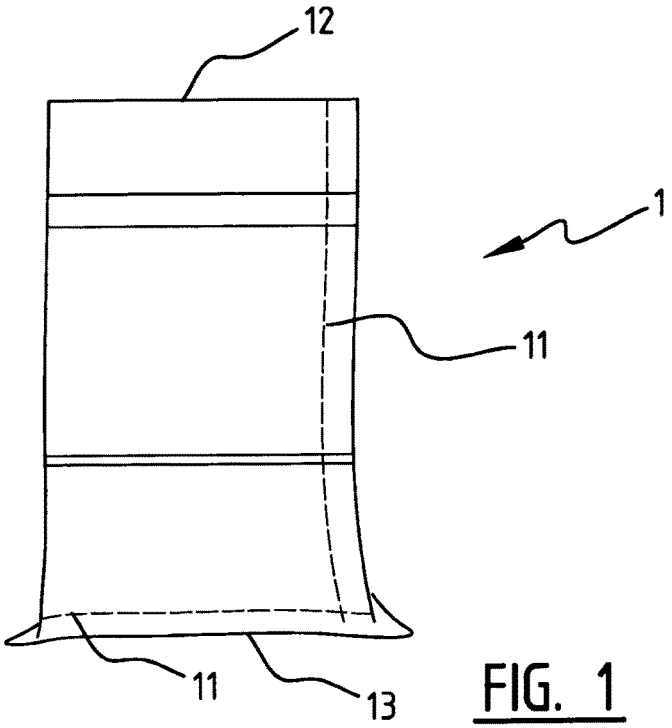

U.S. PATENT DOCUMENTS 5,830,543 A * 11/1998 Miyake ..... A61L 15/60 206/204
5,845,994 A * 12/1998 Rice ..... 383/76
5,913,607 A * 6/1999 Lengyel, Sr. ..... 383/84
5,964,533 A * 10/1999 Ziglar ..... 383/36
6,461,386 B1 * 10/2002 Chan et al. ..... 8/115.51
6,726,362 B1 * 4/2004 Frisch et al. ..... 383/103
6,787,491 B2 * 9/2004 Braekevelt ..... 442/212
6,966,696 B1 * 11/2005 Curry et al. ..... 383/2
6,995,124 B1 * 2/2006 Wernicke et al. ..... 510/285
7,056,023 B2 * 6/2006 Heidel ..... 383/117
7,080,653 B2 * 7/2006 Zheng ..... 135/126
7,214,847 B1 * 5/2007 Flick ..... A61F 13/00008 428/103
7,232,777 B1 * 6/2007 Van Hyning ..... 442/123
7,306,369 B2 * 12/2007 Curry et al. ..... 383/2
7,338,709 B1 * 3/2008 Wada et al. ..... 428/379
9,114,197 B1 * 8/2015 Dehnad ..... A61L 31/088
2003/0157147 A1 * 8/2003 Hoge ..... A01N 25/34 424/443
2004/0049145 A1 * 3/2004 Flick ..... A61F 13/00008 602/41
2005/0129337 A1 * 6/2005 Sabounjian ..... 383/117
2005/0244484 A1 * 11/2005 Flick ..... A61F 13/00034 424/445
2006/0018567 A1 * 1/2006 Curry et al. ..... 383/2
2006/0050998 A1 * 3/2006 Cohen ..... 383/41
2006/0269174 A1 * 11/2006 Huffer ..... B65D 75/5833 383/207
2008/0171068 A1 * 7/2008 Wyner et al. ..... 424/404
2008/0179330 A1 * 7/2008 Brooks et al. ..... 220/495.08
2008/0226204 A1 * 9/2008 Sabounjian et al. ..... 383/74
2008/0268732 A1 * 10/2008 Green et al. ..... 442/117
2009/0019624 A1 * 1/2009 Birk et al. ..... 2/455
2009/0246258 A1 * 10/2009 Shukla et al. ..... 424/443
2011/0229062 A1 * 9/2011 Sulger ..... A21C 15/005 383/116
2012/0029458 A1 * 2/2012 Norman ..... A45C 3/001 604/385.14
2012/0117708 A1 * 5/2012 Trapani ..... A41D 13/1209 2/83
2012/0129418 A1 * 5/2012 Ingle ..... A47G 9/007 442/371
2012/0276332 A1 * 11/2012 Conolly ..... C23C 14/562 428/138
2012/0288662 A1 * 11/2012 Conolly ..... A43B 1/0045 428/87
2015/0359946 A1 * 12/2015 Dehnad ..... A61L 29/16 424/411
2016/0136335 A1 * 5/2016 Dehnad ..... A61L 31/06 424/411
2016/0198790 A1 * 7/2016 Ishmael ..... A43B 3/106 2/239

FOREIGN PATENT DOCUMENTS

JP H08302562 11/1996
JP 11042164 2/1999

* cited by examiner

HOLDER FOR LAUNDRY AND METHOD FOR MANUFACTURING SUCH HOLDER

The present invention relates to a holder for laundry, in particular a laundry bag, and a method for manufacturing such a holder, in particular a laundry bag.

In for instance hotels, hospitals, retirement homes, private homes and production facilities, it is common to use laundry holders, in particular bags or covers for collecting and/or distributing laundry. Various types of laundry from various locations, for instance rooms, can then efficiently be collected and/or distributed. A laundry holder filled with dirty laundry can be transported to a laundry room or external laundry facility for further processing. A laundry holder filled with clean laundry can be transported from a laundry room or external facility for distribution of the clean laundry to for instance rooms. Since the laundry holders are exposed to dirty laundry and/or dirty surroundings during use, it is necessary to wash said laundry bags after use.

Especially in hospitals, laundry holders are exposed to all kinds of potentially hazardous substances, such as bacteria, blood and other bodily fluids. In particular when the filled laundry holders are collected and thereby stored for a period of time, bacteria present in the laundry may proliferate and contaminate the laundry, and the laundry holder and its surroundings. Likewise, clean laundry stored and transported in a laundry holder can be infected by its surroundings.

In order to overcome this problem, it was suggested to provide fluid—and preferably airtight laundry holders.

Hazardous substances are hereby prevented to contaminate the outside surface of said laundry holders. However, providing an airtight laundry bag results in increased bacteria proliferation.

It is therefore a goal of the present invention, among others goals, to provide an improved holder for laundry wherein the above mentioned problem is at least partially solved. In particular, it is a goal to provide a more efficient and/or safer holder for laundry.

The above goal is met by the present invention, amongst other goals, by a holder for laundry as defined in the appended claim 1.

Specifically, the above goal, amongst other goals, is met by the present invention by a holder for laundry, in particular a laundry bag, manufactured from a woven textile, wherein the textile has an air permeable structure allowing said textile to breathe and wherein said textile comprises first threads provided with an anti-bacterial agent. A plurality of threads with an anti-bacterial agent in the textile prevents bacteria from growing or being transferred from the holder for laundry. Preferably, a first thread comprises at least one fibre, more preferably a plurality of fibres, provided with an anti-bacterial agent.

With an anti-bacterial agent, a substance is meant which destroys bacteria or suppresses their growth or their ability to reproduce Since the holder for laundry allows the contained laundry to breath, laundry getting heated and the resulting proliferation of bacteria due to heating is prevented. In the known airtight laundry bags, an increased proliferation of bacteria's was detected, thereby staining the laundry and making further processing of said laundry more difficult. Further, using a textile instead of an airtight material such as plastic, decreases the chance of the holder for laundry getting ripped open.

The air permeability of the textile is preferably between 20 and 750 liter ($m^2 \times s$) and more preferably between 50 and 400 liter ($m^2 \times s$) as measured by ISO 9237:1995 at 200 Pa pressure and a test surface of 20 $cm^2$.

It should be noted that the invention is not limited to holders for laundry in the form of laundry bags only. For instance, a holder for laundry also includes liners that can be put on the inside of a container, a trolley or a closet. A holder for laundry also includes covers that can be placed around a container, a cart or a similar device which contains clean laundry. In this way, the cover shields the clean laundry inside from potential contamination from the outside. The laundry holder is further not limited to a particular size or shape. The holder for laundry may for instance have a rectangular or circular cross section.

Preferably, the holder for laundry is arranged closable such that the contained laundry can be shielded from the surroundings. The holder may therefore be provided with closing means, for instance in the form of a zipper, a toggle and/or a closing cord.

Preferably, the holder for laundry is manufactured from a textile chosen from the group of cotton or other natural materials (e.g. bamboo, hemp etc.), polyester, polyamide, polypropylene or a combination thereof. According to a preferred embodiment, the holder for laundry is manufactured from polyester for its wear and wash resistant properties.

Preferably the anti-bacterial agent comprises silver. Silver provides good anti-bacterial properties and is widely available. The first threads may be provided with fibres provided with silver, for instance in the form of silver particles dispersed over the fibre. For instance, 10% of the fibres provided in a thread may be fibres provided with an anti-bacterial agent. According to a further preferred embodiment, the silver content of the textile is at least 0.05% to 1.5% by weight.

The amount of anti-bacterial agent provided in the textile may be adapted to the degree of bacteria inhibition required for the application. It may for instance be required that only contamination of the outer surface of the holder must be prevented. However, for another application it may be required that bacteria also need to be eliminated inside the holder. The amount of anti-bacterial substance may thus be adapted accordingly.

According to a preferred embodiment of the holder for laundry according to the invention, the textile further comprises second heat conducting threads. The heat conducting threads provide heat dissipating properties to the textile. This further prevents the laundry in the holder from getting heated, further inhibiting bacterial growth. Preferably the second threads comprise a material chosen from the group of carbon, aluminium, gold, copper, stainless steel or a combination thereof. The second threads may for instance comprise heat conducting fibres.

According to a further preferred embodiment of the holder for laundry according to the invention the first and second threads are formed integral. Only a single different thread has to be included in the textile, resulting in a textile which is more efficient to fabricate. The threads may for instance be provided with fibres provided with an anti-bacterial agent and with fibres provided with heat conducting properties.

According to a further preferred embodiment of the holder for laundry according to the invention the textile comprises threads containing silver coated fibres. By providing a fibre with a coating from silver, said thread has both anti-bacterial and heat dissipating properties, since silver has good heat conducting properties. Using a single type of fibre, the thread and thereby the textile has both anti-bacterial and heat dissipating properties.

It should be noted that with the term coated as used herein, a distribution of silver on a fibre is meant whereby a conducting fibre is provided. It may for instance be possible to provide only a part of the surface of a fibre with the coating of silver, provided that a closed path of silver is formed along at least a length of said fibre and thereby the thread.

According to a further preferred embodiment of the holder for laundry according to the invention, said threads are provided in one of the warp or the weft. Providing only the warp or the weft with the threads according to the invention, that is the first and/or the second threads, allows efficient weaving.

According to a further preferred embodiment of the holder for laundry according to the invention, at least one thread of every three threads in the warp or the weft is a first and/or a second thread. Preferably, every other thread is a first and/or a second thread and even more preferably every thread in the warp and/or the weft is a first and/or a second thread. Using a single type of thread for the weft and/or the warp allows more efficient weaving.

The invention further relates to a method for manufacturing an anti-bacterial holder for laundry according to the invention, comprising the steps of providing a woven textile, wherein the textile has an air permeable structure allowing said textile to breathe and wherein said textile comprises first threads provided with an anti-bacterial agent, and forming a holder for laundry from said textile.

The present invention furthermore relates to the use of the textile as defined above for manufacturing an anti-bacterial, anti-static holder for laundry. Since heat conducting materials generally have good electricity conducting properties, the holder for laundry according to the invention also has anti-static properties. In particular, when threads containing silver coated fibres are used in the textile, a holder for laundry is provided having good anti-bacterial and anti-static properties.

Figure 2:
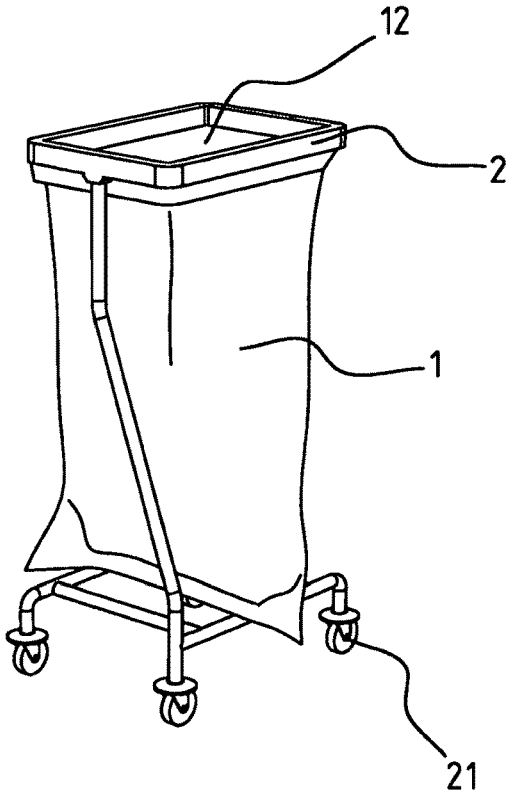
Figure 3:
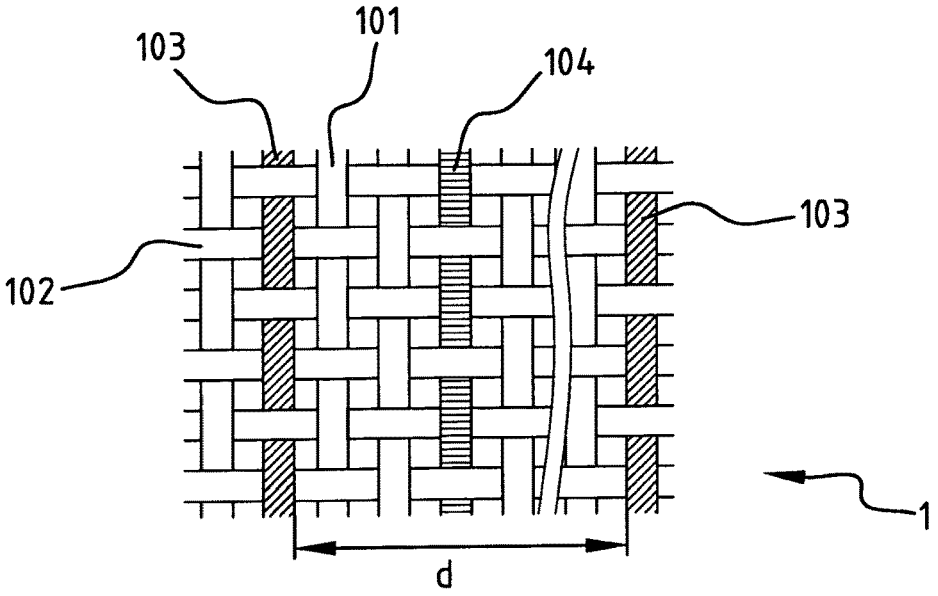
Figure 4:
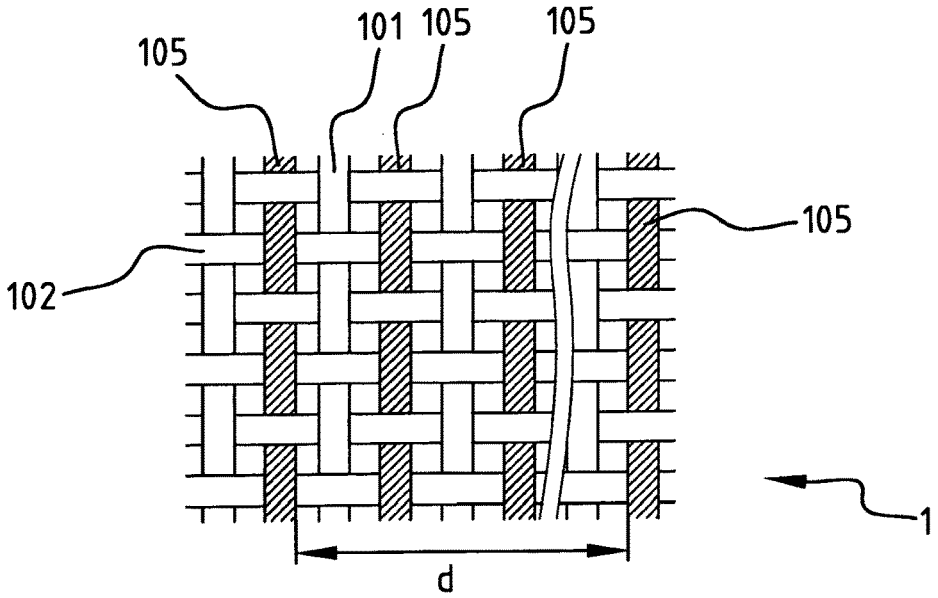

The present invention is further illustrated by the following Figures, which show a preferred embodiment of the device according to the invention, and are not intended to limit the scope of the invention in any way, wherein:

FIGS. 1 and 2 schematically show two embodiments of the laundry bag, and;

FIGS. 3 and 4 schematically show two textiles used in the laundry bag.

In FIGS. 1 and 2 laundry bags 1 according the invention are shown. The laundry bag 1 is manufactured from a relative air permeable textile, allowing the textile to breath. The air permeability of the textile is 290 liter ($m^2 \times s$), as measured by ISO 9237:1995 at 200 Pa pressure and a test surface of 20 $cm^2$. In this example, the laundry bag is manufactured from polyester.

The laundry bag shown in FIG. 1 is formed by sowing a piece of textile together into a bag with an opening 12. The end 13 is closed. Seams 11 are visible in FIG. 1. The bag from FIG. 2 is formed into a substantially rectangular shape, allowing the bag 1 to be placed in a frame 2 provided with wheels 21. The bag can for example be equipped with a system for closing it and/or hanging it into a frame.

In FIG. 3 a detail of the laundry bag 1 is shown. The woven textile is made of polyester threads 101 and 102. In the weft, a thread 103 is inserted which contains fibres provided with silver particles. The silver provides anti-bacterial properties to the laundry bag 1. The silver content of the textile is 0.45% by weight.

Also included in the weft is a thread 104 provided with a copper fibre. The copper thread 104 has good heath conducting capacities, allowing heat to be distributed over the surface of said bag 1. This provides efficient heat dissipation, inhibiting bacterial growth and thereby increasing the anti-bacterial properties of the laundry bag 1. Furthermore, the fibre 104 also provides anti-static properties, since copper has good electricity conducting properties.

As shown in FIG. 3, two normal polyester threads 101 extend between the thread 103 provided with silver and the thread 104 provided with copper. However, it may for instance also be possible that the threads 103 and 104 lay adjacent and that all the threads in the weft are threads 103 or 104 provided with silver or copper.

The textile as shown in FIG. 4 only comprises a thread 105 included in the weft, which contains fibres coated with silver. 20% of the fibres in thread 105 are coated with silver and each silver coated fibre contains 15% silver. Thread 105 therefore provides both anti-bacterial properties as heat dissipating properties, further increasing the anti-bacterial properties. In this example, the two threads 105 are spaced apart by a distance d. However, it may also be possible use only threads 105 in the weft.

The present invention is not limited to the embodiment shown, but extends also to other embodiments falling within the scope of the appended claims.

The invention claimed is:

1. Woven holder for laundry manufactured from a woven textile, wherein the woven textile has an air permeability allowing said woven textile to breathe and wherein said woven textile comprises:

polyester threads; and first threads provided with an anti-bacterial agent, the first threads comprised of at least one individual fiber, the polyester threads and first threads woven together, wherein the anti-bacterial agent comprises silver and wherein the silver is distributed in the form of particles on the at least one individual fiber(s) of only the first threads such that the first threads are not completely coated with silver, but comprised of at least one individual fiber coated with silver particles.

2. Woven holder for laundry according to claim 1, wherein said first threads are provided in one of a warp or a weft position of the woven holder for laundry.

3. Woven holder for laundry according to claim 1, wherein the textile comprises 0.05% to 1.5% by weight of silver.

4. Method for manufacturing an anti-bacterial woven holder for laundry, in particular a laundry bag, according to claim 1, comprising the steps of providing a woven textile, wherein the textile has an air permeability allowing said textile to breathe and wherein said textile comprises first threads provided with an anti-bacterial agent, and forming a woven holder for laundry from said textile.

5. Method according to claim 4, wherein the textile furthermore comprises second heat conducting threads.

6. Method according to claim 4, wherein the textile comprises threads which contain silver coated fibers.

7. Method of using a textile for manufacturing an anti-bacterial, anti-static woven holder for laundry wherein the textile comprises:

a plurality of first threads provided with an anti-bacterial agent;

a plurality of second heat conducting threads comprised of a material chosen from the group of aluminum, gold, copper, stainless steel or a combination thereof, the first threads and second threads are formed integral;

a plurality of polyester threads, wherein the anti-bacterial agent comprises silver and wherein the silver is distributed in the form of particles only on the first threads, wherein said threads are provided in one of the warp or the weft, and wherein the textile is woven and comprises 0.05% to 1.5% by weight of silver.

8. The woven holder for laundry according to claim 1, wherein the woven textile has an air permeability between 20 and 750 liter ($m^2 \times s$).

9. The woven holder for laundry according to claim 8, wherein the woven textile more preferably has an air permeability between 50 and 400 liter ($m^2 \times s$).

10. The woven holder for laundry of claim 1 wherein the first threads provided with an anti-bacterial agent are comprised of polyester threads.

11. A woven textile for use as a holder for laundry, wherein the woven textile has an air permeability allowing said woven textile to breathe and wherein the woven textile comprises a plurality of woven threads, the woven thread comprised of individual fibers, at least one of the individual fibers included within the woven thread having distributed thereon silver particles as an anti-bacterial agent and at least one of the individual fibers included within the woven thread lacking any silver particle distribution.

* * * * *